US009279302B2

(12) United States Patent
Mireles

(10) Patent No.: US 9,279,302 B2
(45) Date of Patent: Mar. 8, 2016

(54) PLUG COUNTER AND DOWNHOLE TOOL

(71) Applicant: Hector H. Mireles, Spring, TX (US)

(72) Inventor: Hector H. Mireles, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 352 days.

(21) Appl. No.: 13/910,597

(22) Filed: Jun. 5, 2013

(65) Prior Publication Data

US 2013/0264049 A1 Oct. 10, 2013

Related U.S. Application Data

(63) Continuation of application No. 12/564,539, filed on Sep. 22, 2009, now Pat. No. 8,479,823.

(51) Int. Cl.

| | |
|---|---|
| ***E21B 34/10*** | (2006.01) |
| ***E21B 23/00*** | (2006.01) |
| ***E21B 17/22*** | (2006.01) |
| ***E21B 23/04*** | (2006.01) |
| ***E21B 33/12*** | (2006.01) |

(52) U.S. Cl.

CPC ..... *E21B 23/004* (2013.01); *E21B 17/22* (2013.01); *E21B 23/04* (2013.01); *E21B 33/12* (2013.01)

(58) Field of Classification Search

CPC ..... E21B 23/006; E21B 34/10
USPC ..... 166/331, 332.2, 333.2, 318, 373
See application file for complete search history.

(56) References Cited

U.S. PATENT DOCUMENTS

| | | | |
|---|---|---|---|
| 1,883,071 | A | 12/1928 | Stone |
| 2,277,816 | A | 3/1942 | Brown |
| 2,376,594 | A | 5/1945 | Hite |
| 2,448,423 | A | 8/1948 | Dodge |
| 2,562,455 | A | 7/1951 | Gridley |
| 2,769,454 | A | 11/1956 | Bletcher et al. |
| 2,812,717 | A | 11/1957 | Brown |
| 2,822,757 | A | 2/1958 | Colberly |
| 2,973,006 | A | 2/1961 | Nelson |
| 3,007,527 | A | 11/1961 | Nelson |
| 3,013,612 | A | 12/1961 | Angel |
| 3,117,797 | A | 1/1964 | Buck |

(Continued)

FOREIGN PATENT DOCUMENTS

| | | |
|---|---|---|
| CA | 2760107 | 11/2010 |
| CA | 2731161 C | 6/2013 |

(Continued)

OTHER PUBLICATIONS

Canadian Office Action for CA Application No. 2,794,111, dated Jul. 24, 2014, pp. 1-3.

(Continued)

*Primary Examiner* — Blake Michener
*Assistant Examiner* — Kipp Wallace
(74) *Attorney, Agent, or Firm* — Cantor Colburn LLP

(57) ABSTRACT

A plug counter including a housing sized to receive and pass plugs. A helix sleeve rotatably positioned relative to the housing. The helix sleeve including a helical track having a plurality of consecutive turns. A key positionable relative to the helical track and responsive to movement of the helix sleeve in a first rotational direction, wherein the key prevents further movement of the helix sleeve in the first rotational direction after a selected number of plugs pass through the plug counter.

19 Claims, 3 Drawing Sheets

(56) References Cited

U.S. PATENT DOCUMENTS 3,148,731 A 9/1964 Holden
3,211,232 A 10/1965 Grimmer
3,263,752 A 8/1966 Conrad
3,358,771 A 12/1967 Berryman
3,510,103 A 5/1970 Carsello
3,517,939 A 6/1970 Jaehn
3,566,964 A 3/1971 Livingston
3,583,714 A 6/1971 Weltzer et al.
3,599,998 A 8/1971 Kiwalle et al.
3,667,505 A 6/1972 Radig
3,669,462 A 6/1972 Parsons
3,703,104 A 11/1972 Tamplen
3,727,635 A 4/1973 Todd
3,761,008 A 9/1973 Goulder
3,797,255 A 3/1974 Kammerer, Jr. et al.
3,901,315 A 8/1975 Parker et al.
3,954,138 A 5/1976 Miffre
3,997,003 A 12/1976 Adkins
4,067,358 A 1/1978 Streich
4,160,478 A 7/1979 Calhoun et al.
4,176,717 A 12/1979 Hix
4,190,239 A 2/1980 Schwankhart
4,246,968 A 1/1981 Jessup et al.
4,260,017 A 4/1981 Nelson et al.
4,291,722 A 9/1981 Churchman
4,292,988 A 10/1981 Montgomery
4,355,685 A 10/1982 Beck
4,390,065 A 6/1983 Richardson
4,423,777 A 1/1984 Mullins et al.
4,433,726 A 2/1984 Preston, Jr. et al.
4,438,811 A 3/1984 Patel
4,448,216 A 5/1984 Speegle et al.
4,474,241 A 10/1984 Freeman
4,478,279 A 10/1984 Puntar et al.
4,513,822 A 4/1985 Gilbert
4,537,383 A 8/1985 Fredd
4,554,981 A 11/1985 Davies
4,566,541 A 1/1986 Moussy et al.
4,576,234 A 3/1986 Upchurch
4,583,593 A 4/1986 Zunkel et al.
4,655,290 A 4/1987 Smith, Jr.
4,657,078 A 4/1987 Fraser, III et al.
4,662,785 A 5/1987 Gibb et al.
4,669,538 A 6/1987 Szarka
4,711,326 A 12/1987 Baugh et al.
4,714,116 A 12/1987 Brunner
4,715,445 A 12/1987 Smith, Jr.
4,726,425 A 2/1988 Smith, Jr.
4,729,432 A 3/1988 Helms
4,762,447 A 8/1988 Marantette
4,823,882 A 4/1989 Stokley et al.
4,826,135 A 5/1989 Mielke
4,856,591 A 8/1989 Donovan et al.
4,893,678 A 1/1990 Stokley et al.
4,944,379 A 7/1990 Haaser
4,949,788 A 8/1990 Szarka et al.
4,979,561 A 12/1990 Szarka
4,991,653 A 2/1991 Schwegman
4,991,654 A 2/1991 Brandell et al.
5,020,946 A 6/1991 Nann
5,029,643 A 7/1991 Winslow et al.
5,029,644 A 7/1991 Szarka et al.
5,056,599 A 10/1991 Comeaux et al.
5,117,913 A 6/1992 Themig
5,207,274 A 5/1993 Streich et al.
5,230,390 A 7/1993 Zastresek et al.
5,244,044 A 9/1993 Henderson
5,297,580 A 3/1994 Thurman
5,305,837 A 4/1994 Johns et al.
5,325,917 A 7/1994 Szarka
5,335,727 A 8/1994 Cornette et al.
5,343,946 A 9/1994 Morrill
5,343,954 A 9/1994 Bohlen et al.
5,381,862 A 1/1995 Szarka et al.
5,394,941 A 3/1995 Venditto et al.
5,398,947 A 3/1995 Cook
5,425,424 A 6/1995 Reinhardt et al.
5,529,126 A 6/1996 Edwards
5,551,512 A 9/1996 Smith
5,567,093 A 10/1996 Richmond
5,609,178 A 3/1997 Hennig et al.
5,620,050 A 4/1997 Barbee
5,695,009 A 12/1997 Hipp
5,704,393 A 1/1998 Connell et al.
5,762,142 A 6/1998 Connell et al.
5,775,421 A 7/1998 Duhon et al.
5,775,428 A 7/1998 Davis et al.
5,813,483 A 9/1998 Latham et al.
5,890,540 A * 4/1999 Pia et al. ..... 166/321
5,960,881 A 10/1999 Allamon et al.
6,050,340 A 4/2000 Scott
6,053,250 A 4/2000 Echols
6,056,053 A 5/2000 Giroux et al.
6,079,496 A 6/2000 Hirth
6,102,060 A 8/2000 Howlett et al.
6,155,350 A 12/2000 Melenyzer
6,173,795 B1 * 1/2001 McGarian et al. ..... 175/231
6,220,350 B1 4/2001 Brothers et al.
6,227,298 B1 5/2001 Patel
6,253,861 B1 7/2001 Carmichael et al.
6,293,517 B1 9/2001 Cunningham
6,378,609 B1 4/2002 Oneal et al.
6,474,412 B2 11/2002 Hamilton et al.
6,530,574 B1 3/2003 Bailey et al.
6,547,007 B2 4/2003 Szarka et al.
6,571,880 B1 6/2003 Butterfield, Jr. et al.
6,626,244 B2 9/2003 Powers
6,634,428 B2 10/2003 Krauss et al.
6,644,412 B2 11/2003 Bode et al.
6,666,273 B2 12/2003 Laurel
6,668,933 B2 12/2003 Kent
6,681,860 B1 1/2004 Yokley et al.
6,712,145 B2 3/2004 Allamon
6,712,415 B1 3/2004 Darbishire et al.
6,763,891 B2 7/2004 Humphrey et al.
6,834,726 B2 12/2004 Giroux et al.
6,866,100 B2 3/2005 Gudmestad et al.
6,896,049 B2 5/2005 Moyes
6,907,936 B2 6/2005 Fehr et al.
6,948,561 B2 9/2005 Myron et al.
6,983,795 B2 1/2006 Zuklic et al.
7,150,326 B2 12/2006 Bishop et al.
7,210,534 B2 5/2007 Hayter et
7,322,408 B2 1/2008 Howlett
7,322,417 B2 1/2008 Rytlewski et al.
7,325,617 B2 2/2008 Murray
7,337,847 B2 3/2008 McGarian et al.
7,350,578 B2 4/2008 Szarka et al.
7,367,399 B2 5/2008 Steele et al.
7,377,321 B2 5/2008 Rytlewski
7,387,165 B2 6/2008 Lopez de Cardenas et al.
7,416,029 B2 8/2008 Telfer et al.
7,467,664 B2 12/2008 Cochran et al.
7,503,390 B2 3/2009 Gomez
7,503,392 B2 3/2009 King et al.
7,520,336 B2 4/2009 Mondelli et al.
7,703,510 B2 4/2010 Xu
7,730,953 B2 6/2010 Casciaro
7,798,212 B2 9/2010 Bolze et al.
7,832,472 B2 11/2010 Themig
7,909,120 B2 3/2011 Slack
7,971,883 B2 7/2011 Soroka et al.
8,061,429 B2 11/2011 Du et al.
8,291,988 B2 10/2012 King
8,393,389 B2 3/2013 Brisco et al.
8,443,894 B2 5/2013 Coghill et al.
8,684,096 B2 4/2014 Harris et al.
8,727,010 B2 5/2014 Turner et al.
2001/0007284 A1 7/2001 French et al.
2002/0170717 A1 11/2002 Venning et al.
2004/0007365 A1 1/2004 Hill et al.
2004/0221984 A1 11/2004 Cram
2005/0061372 A1 3/2005 McGrath et al.
2005/0072572 A1 4/2005 Churchill

(56) References Cited

U.S. PATENT DOCUMENTS

| | | | |
|---|---|---|---|
| 2005/0126638 | A1 | 6/2005 | Gilbert |
| 2005/0205264 | A1 | 9/2005 | Starr et al. |
| 2006/0124310 | A1 | 6/2006 | Lopez De Cardenas et al. |
| 2006/0169463 | A1 | 8/2006 | Howlett |
| 2006/0175092 | A1 | 8/2006 | Mashburn |
| 2006/0213670 | A1 | 9/2006 | Bishop et al. |
| 2006/0243455 | A1 | 11/2006 | Telfer et al. |
| 2007/0007007 | A1 | 1/2007 | Themig et al. |
| 2007/0012438 | A1 | 1/2007 | Hassel-Sorensen |
| 2007/0023087 | A1 | 2/2007 | Krebs et al. |
| 2007/0095538 | A1 | 5/2007 | Szarka et al. |
| 2007/0272413 | A1 | 11/2007 | Rytlewski et al. |
| 2007/0289749 | A1 | 12/2007 | Wood et al. |
| 2008/0066924 | A1 | 3/2008 | Xu |
| 2008/0093080 | A1 | 4/2008 | Palmer et al. |
| 2008/0190620 | A1 | 8/2008 | Posevina et al. |
| 2008/0217025 | A1 | 9/2008 | Ruddock et al. |
| 2008/0308282 | A1 | 12/2008 | Standridge et al. |
| 2009/0032255 | A1 | 2/2009 | Surjaatmadja et al. |
| 2009/0044944 | A1 | 2/2009 | Murray et al. |
| 2009/0044946 | A1 | 2/2009 | Schasteen et al. |
| 2009/0044948 | A1 | 2/2009 | Avant et al. |
| 2009/0044955 | A1 | 2/2009 | King et al. |
| 2009/0056934 | A1 | 3/2009 | Xu |
| 2009/0056952 | A1 | 3/2009 | Churchill |
| 2009/0101330 | A1 | 4/2009 | Johnson |
| 2009/0107680 | A1 | 4/2009 | Surjaatmadja |
| 2009/0159289 | A1 | 6/2009 | Avant et al. |
| 2009/0308588 | A1 | 12/2009 | Howell et al. |
| 2010/0294514 | A1 | 11/2010 | Crow et al. |
| 2011/0048723 | A1 | 3/2011 | Edwards |
| 2011/0073330 | A1 | 3/2011 | Radford |
| 2011/0108284 | A1 | 5/2011 | Flores et al. |
| 2011/0174500 | A1 | 7/2011 | Davies et al. |
| 2011/0180274 | A1 | 7/2011 | Wang et al. |

FOREIGN PATENT DOCUMENTS

| | | | |
|---|---|---|---|
| EP | 0427422 | A2 | 5/1991 |
| GB | 2281924 | | 3/1995 |
| JP | 63174808 | A | 7/1988 |
| WO | 0015943 | | 3/2000 |

OTHER PUBLICATIONS

Canadian Office Action for related CA Application No. 2,807,471, dated May 26, 2014, pp. 1-2.

Hoch, Ottmar, Marty Stromquist et al., "Multiple Precision Hydraulic Fractures of Low Permeability Horizontal Openhole Sandstone Wells," SPE Annual Technical Conference and Exhibition, Oct. 5-8, 2003, Denver Colorado.

International Search Report for PCT Application No. PCT/US2010/034752, dated Jan. 27, 2011, pp. 1-3.

International Search Report with Written Opinion; International Application No. PCT/US2011/029622; International Filing Date: Nov. 8, 2010; 9 pages.

Response to Restriction Requirement dated Apr. 22, 2009 in U.S. Appl. No. 11/891,715, U.S. Patent and Trademark Office, U.S.A.

Office Action dated Apr. 9, 2009, in U.S. Appl. No. 11/891,715, U.S. Patent and Trademark Office, U.S.A.

Ross, C. M., et al., "Current Materials and Devices for Control of Fluid Loss," SPE 54323, Apr. 1999, pp. 1-16.

Hoffman, C.R., "One-Trip Sand-Control/Liner Hangar/ Big-Bore Completion System," SPE 101086, Sep. 2006, pp. 1-10.

Baker Hughes, Baker Oil Tools, Conventional Fishing Technical Unit; Pump Out Sub Product Family No. H14061, Jun. 7, 2005, 1 page.

International Search Report, Feb. 11, 2009 pp. 1-3, PCT/US2008/072732, Korean Intellectual Property Office.

International Search Report, Feb. 11, 2009, pp. 1-3, PCT/US2008/072734, Korean Intellectual Property Office.

International Search Report, Feb. 11, 2009, pp. 1-3, PCT/US2008/072735, Korean Intellectual Property Office.

Notification of Transmittal of the International Search Report and the Written Opinion of the International Searching Authority, or the Declaration, Feb. 11, 2009, pp. 1-4, PCT/US2008/072732, Korean Intellectual Property Office.

Notification of Transmittal of the International Search Report and the Written Opinion of the International Searching Authority, or the Declaration, Feb. 11, 2009, pp. 1-4, PCT/US2008/072734, Korean Intellectual Property Office.

Notification of Transmittal of the International Search Report and the Written Opinion of the International Searching Authority, or the Declaration, Feb. 11, 2009, pp. 1-4, PCT/US2008/072735, Korean Intellectual Property Office.

Written Opinion of the International Searching Authority, Feb. 11, 2009, pp. 1-3, PCT/US2008/072732, Korean Intellectual Property Office.

Written Opinion of the International Searching Authority, Feb. 11, 2009, pp. 1-4, PCT/US2008/072734, Korean Intellectual Property Office.

Written Opinion of the International Searching Authority, Feb. 11, 2009, pp. 1-4, PCT/US2008/072735, Korean Intellectual Property Office.

G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.

International Search Report; PCT/US2010/044399; International Searching Authority KIPO; Mailed Mar. 21, 2011.

International Search Report and Written Opinion of the International Searching Authority; PCT/US2010/044378; Mailed Mar. 17, 2011.

Notification of Transmittal of the International Search Report and the Written Opinion of the International Searching Authority; PCT/US2010/044856; Mailed Apr. 15, 2011.

Notification of Transmittal of the International Search Report and the Written Opinion of the International Searching Authority; PCT/US2010/044383; Mailed Apr. 15, 2011.

International Search Report; PCT/US2010/033737; Korean Intellectual Property Office; Mailed Jan. 24, 2011.

International Search Report; Date of Mailing Jan. 24, 2011; International Appln No. PCT/US2010/034736; 3 Pages.

International Search Report; Date of Mailing Jan. 24, 2011; Internatiaonal Appln. No. PCT/US2010/034735; 3 Pages.

International Search Report and Written Opinion; Date of Mailing Feb. 11, 2011; International Appln No. PCT/US2010/041049; International Search Report 5 Pages and Written Opinion 3 Pages.

Notification of Transmittal of the International Search Report and the Written Opinion of the International Searching Authority; PCT/US2010/054487; International Searching Authority; KIPO; Mailed Jun. 3, 2011.

Notification of Transmittal of the International Search Report and the Written Opinion of the International Searching Authority; PCT/US2010/049810; International Searching Authority KIPO; Mailed Apr. 25, 2011.

International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.

Notification of Transmittal of the International Search Report and the Written Opinion of the International Searching Authority; PCT/US2011/041663; Korean Intellectual Property Office; Mailed Dec. 14, 2011; 8 pages.

Boscan, J. et al., "Successful Well Testing Operations in High-Pressure/High-Temperature Encironment; Case Histories," SPE 84096, Oct. 2003, pp. 1-15.

International Search Report, Jan. 19, 2009, pp. 1-3, PCT/US2008/072470, Korean Intellectual Property Office.

Notification of Transmittal of the International Search Report and the Written Opinion of the International Searching Authority, or the Declaration, Jan. 19, 2009, pp. 1-4, PCT/US2008/072470, Korean Intellectual Property Office.

(56) References Cited

OTHER PUBLICATIONS

Written Opinion of the International Searching Authority, Jan. 19, 2009, pp. 1-3, PCT/US2008/072470, Korean Intellectual Property Office.

Notice of Allowance & Fees Due and Notice of Allowability dated Jan. 5, 2009, in U.S. Appl. No. 11/891,713, U.S. Patent and Trademark Office, U.S.A.

Office Action dated Jul. 16, 2008 in U.S. Appl. No. 11/891,713 U.S. Patent and Trademark Office, U.S.A.

Office Action dated Jun. 19, 2009, in U.S. Appl. No. 11/891,715, U.S. Patent and Trademark Office, U.S.A.

Office Action dated Jun. 25, 2009, in U.S. Appl. No. 11/891,714, USPTO, U.S.A.

Brad Musgrove, Multi-Layer Fracturing Solution Treat and Produce Completions, Nov. 12, 2007, pp. 1-23, Schlumberger, U.S.A.

Response to Office Action dated Oct. 15, 2008, in U.S. Appl. No. 11/891,713, U.S. Patent and Trademark Office, U.S.A.

RFID Keystone Module, RFID & Intelligent Products, Petrowell retrieved online on May 27, 2009 from: http://www.petrowell.co.uk/index2.php?option=com_docman&task=doc_view&gid=15&ltemid=26.

StageFRAC Maximize Reservoir Drainage, 2007, pp. 1-2, Schlumberger, U.S.A.

TAP Completion System, Schlumberger, 4 pages, Dec. 2007.

* cited by examiner 10
14
12
20
16
28
18
22
24
30
32
36
38
34
44
40
42

PLUG COUNTER AND DOWNHOLE TOOL

CROSS REFERENCE TO RELATED APPLICATIONS

This application claims the benefit of an earlier filing date from U.S. Non Provisional application Ser. No. 12/564,539 filed Sep. 22, 2009, the entire disclosure of which is incorporated herein by reference.

BACKGROUND

In the Drilling and completion industries it is often desirable to affect tools or formations at a great distance from a surface located facility such as a rig. One example of an operation intended to affect a formation is a fracturing operation. In order to perform such an operation, hydraulic pressure is built within a tubing string until the pressure exceeds formation capability for holding that pressure and fractures form in the formation. This type of operation is most effective if done in small incremental sections of a borehole for reasons related to control and distribution of fractures to serve the ultimate purpose of the borehole. Such purposes include hydrocarbon production, Carbon Dioxide sequestration, etc.

In the art, fracturing discrete locations of the borehole tends to require a number of tools related to the pressuring of discrete locations. Such tools increase expense initially and generally create other issues to be overcome after the fracturing process is complete such as removal of the tools that enabled the pressuring of a discrete location. Where multiple fracturing locations are contemplated, generally a staged system must be built and administered correctly for it to work. One such system uses progressively larger seat diameters from the toe back to surface and then progressively increasing diameter balls. While the system works well, it is limited by the number of different size balls that can be used. Tolerance is also required in any system (due to such things as irregular shape of tubing secondary to borehole irregularity), which therefore further limits the number of diameters usable in a particular system.

Since fracturing and other operations where it is desirable to isolate discrete locations continue to become more prevalent and ubiquitous, alternate systems for accessing and manipulating the downhole environment is always well received.

SUMMARY

A plug counter including a housing sized to receive and pass plugs; a helix sleeve rotatably positioned relative to the housing, the helix sleeve including a helical track having a plurality of consecutive turns; and, a key positionable relative to the helical track and responsive to movement of the helix sleeve in a first rotational direction, wherein the key prevents further movement of the helix sleeve in the first rotational direction after a selected number of plugs pass through the plug counter.

A downhole tool including a housing having a support and one or more plug passage recesses; a movable plug seat positionable to be supported by the support or aligned with the one or more plug passage recesses; a helix sleeve rotatable in response to movement of the movable plug seat, the helix sleeve having a helical track including a plurality of consecutive turns; and, a key responsive to movement of the helix sleeve and configured to prevent further movement of the helix sleeve and movable plug seat after a selected number of movable plug seat movements.

BRIEF DESCRIPTION OF THE DRAWINGS

Referring now to the drawings wherein like elements are numbered alike in the several Figures.

DETAILED DESCRIPTION

Referring to FIGS. 1-4, a plug counter tool 10 is illustrated in longitudinal cross section in four different positions to make apparent not only its structural constituents but its operation as well. It is initially noted that the term "plug" as used herein is intended to encompass tripping balls, darts, and similar structures that can be propagated through a borehole and/or tubing string to reach remote locations therewithin. The plug counter tool embodiments disclosed herein facilitate the use of a single size plug (or fewer sizes, if desired, in a particular application) for multiple actuation sequences. For example, where multiple fracture points are desired in a borehole, traditional fracturing would require a number of different diameter plugs used sequentially from smaller to larger as operations progress up the hole. With the tool embodiments described herein only one size plug is needed.

Figures 1, 2, 3, 4:
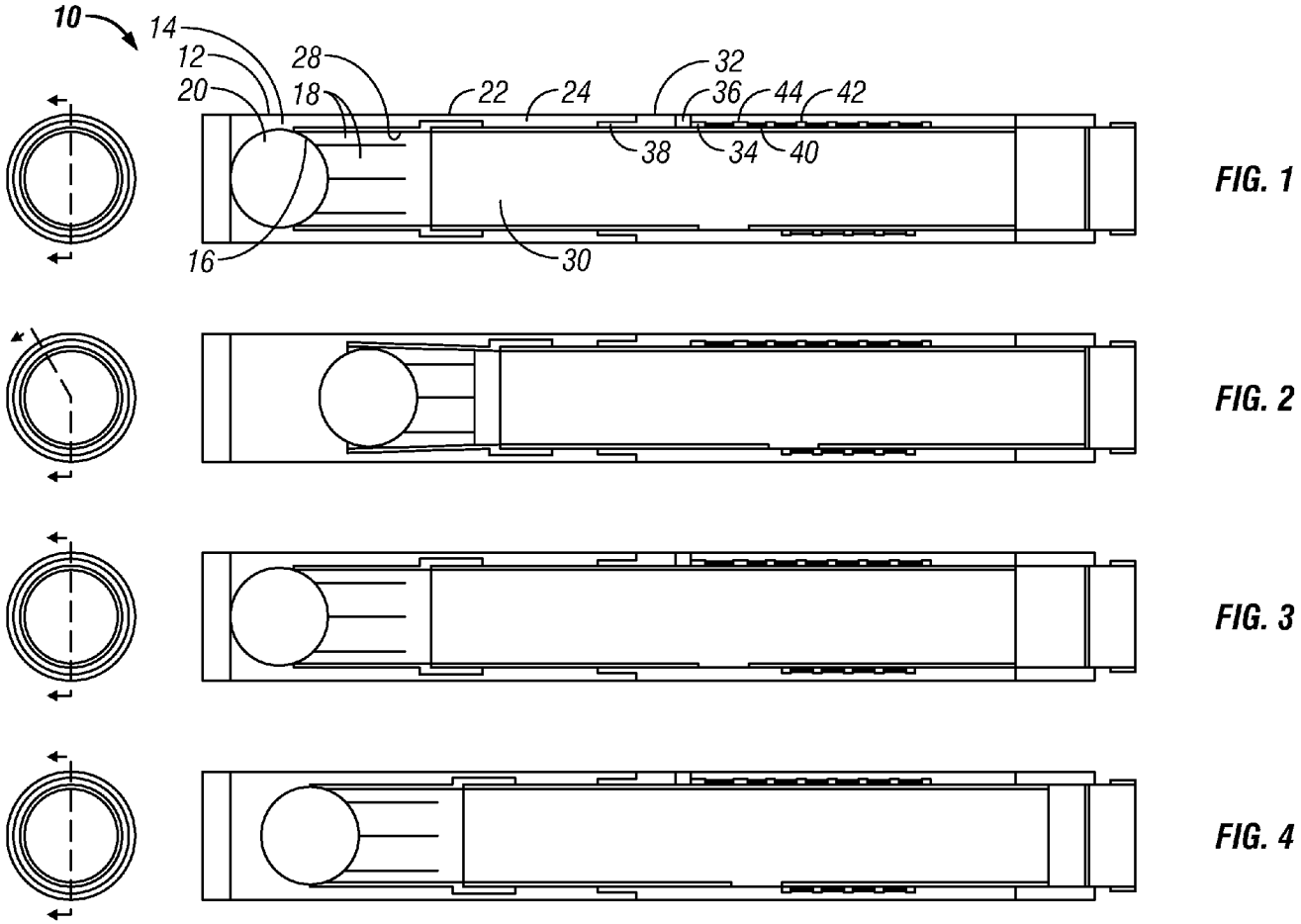
FIGS. 1-4 illustrate a cross sectional view of one embodiment of the tool disclosed herein in four different positions.

Referring directly to FIG. 1, an outer housing 12 includes a support 14 to support a moveable plug seat 16, which in the case of FIG. 1 is presented by a set of collet fingers 18. The support 14 and movable seat 16 operate together to catch a plug 20 after which the plug is passed or denied passage as discussed hereunder. The fingers 18 are supported by support 14 while the collet fingers are in the position shown in FIG. 1. Support for the fingers 18 is dependent upon the position of collet 22, which is dependent upon the ability of a spring 24 to hold the collet 22 in the position shown in FIG. 1. More specifically, when a plug is seated in the seat 16 pressure can and will in operation be built uphole of the plug. The spring rate of the spring 24 selected dictates the amount of fluid pressure that can be resisted before the collet 22 moves in a downhole direction and the fingers 18 become unsupported. The spring 24 is a compression spring and as illustrated is a coil spring. It will hold the collet 22 in the illustrated position until a plug 20 engages the seat 16 and sufficient fluid pressure uphole of the plug overcomes the spring force of spring 24 and compresses the same. As the spring 24 is overcome by fluid pressure, the collet 22 moves in a downhole direction (to the right in the Figure) and moves the fingers 18 off of the support 14. Just downhole of the support 14 is a plug passage recess 28 that will allow radial expansion of the fingers 18 (see FIG. 2) by an amount sufficient to allow passage of the plug 20 through the seat 16. After passage of the plug, fluid pressure equalizes across the seat 16 and the collet 22 returns to the position of FIG. 1 under the bias of the spring 24.

Connected to the collet 22 is j-slot sleeve 30. Sleeve 30 moves axially of the tool 10 along with the collet 22. At a downhole end of the housing 12, an anti-rotation sleeve 32 is attached to the housing. Sleeve 32 does not move relative to housing 12 in any way once the tool is assembled. Anti-rotation sleeve 32 includes one or more pin openings 34 into which one or more pins 36 will be individually inserted. Each pin 36 will thus be fixed to the anti-rotation sleeve 32 and extend into an alignment groove 38 of which there will be one or more in the j-slot sleeve 30. The one or more pins 36 and respective alignment grooves 38 ensure that the j-slot sleeve 30 is not rotatable but is permitted to move only axially during operation of the tool 10. Upon movement of the collet 22 induced by fluid pressure uphole of plug 20 as described above, the j-slot sleeve 30 will cycle back and forth axially of the tool 10.

Radially inwardly of the anti-rotation sleeve 32 and rotatable relative thereto is a helix sleeve 40 exhibiting a helical track 42 at an outside surface thereof. The helix sleeve 40 includes one or more j-slot followers 44 (one shown), which may be a part of the helix sleeve 40 or may be a separate component that is engaged with the helix sleeve 40. In either event, the j-slot follower(s) 44 are configured to contact angled surfaces 46 and 48 of a j-slot 50 (see FIG. 5) disposed at the j-slot sleeve 30 upon axial movement of the j-slot sleeve 30. Because followers 44 are fixed to the helix sleeve 40, the helix sleeve 40 will move rotationally about the j-slot sleeve 30 as the followers 44 move along each angled surface 46 or 48. The impetus for this movement is the axial cycling of the j-slot sleeve 30 as described above. Each time a plug 20 lands at the seat 16, thereby allowing pressure to build from uphole against the plug 20, and hence urging the collet 22 to a position aligning the fingers 18 with recess 28, the followers 44 will contact and slide along one of the angled surfaces 46. This will cause a measured rotation of the helix sleeve 40. Because the spring 24 is compressed during this pressure induced axial movement, energy is stored that will be used to urge the followers 44 along the next adjacent angled surface 48 pursuant to the j-slot sleeve 30 moving uphole under spring bias, causing another measured rotation of the helix sleeve 40. The spring 24 induces such movement only after the plug 20, against which fluid pressure had been applied, is released.

Figure 5:
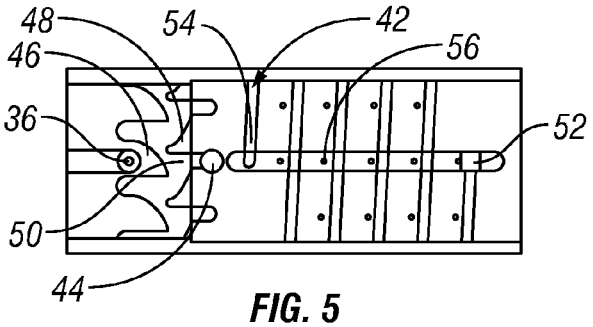
FIGS. 5-8 illustrate in partial transparent view a counter portion of the tool disclosed herein in four different positions corresponding to the positions shown in FIGS. 1-4.
Figure 6:
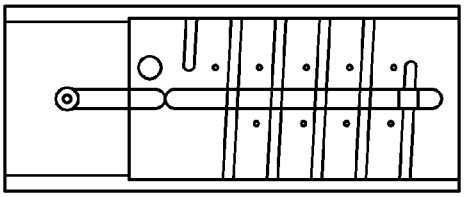
Figure 7:
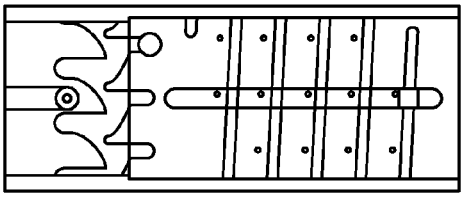
Figure 8:
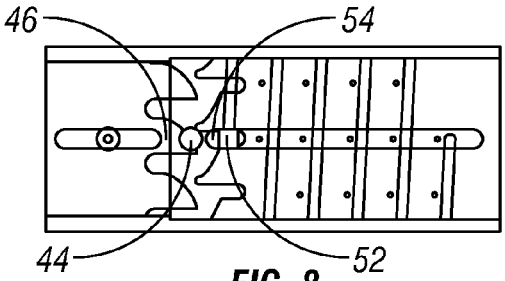

As the helix sleeve 40 rotates, a key 52 that is engaged with the helical track 42 moves leftwardly in the drawing closer to an end 54 of a keyway 56. It is to be appreciated that although the illustrated embodiment moves in an uphole direction, the tool 10 can easily be configured to allow movement of the key 52 in a downhole direction by reversing the helix angle of the helical track 42 and reversing the surface angles of surfaces 46 and 48. As illustrated in FIGS. 1 and 5, the key 52 is in a position that will allow the greatest number of plugs to pass before preventing passage of the next plug to be seated. FIGS. 4 and 8 show the key in the position where the next plug to seat will not pass.

As configured the tool 10 will pass a number of plugs and then prevent further passage of plugs because the helix sleeve 40 is prevented from rotating by the contact between key 52 and an end 54 of keyway 56. The prevention of rotation of the helix sleeve 40 correspondingly prevents the j-slot sleeve 30 from cycling downhole sufficiently to allow the fingers 18 to reach the recess 28. Consequently the plug 20 cannot pass. This position is illustrated best in FIG. 8 where key 52 is at end 54 and follower 44 is at surface 46 but it cannot slide on surface 46 because the key will no longer allow rotation of the helix sleeve 40 due to having run out of helical track 42. It is to be understood, then, that the maximum number of plugs that are passable through tool 10 are fixed by design during manufacture by the length of the helical track 42 and the keyway 56. This is not to say however that this maximum number of plugs is the only number of plugs that will be passable before a plug is denied passage. Rather, because the key is placable in the keyway 56 as the tool is being run into the hole, at any point on the helical track 42 that is exposed to the keyway 56, any number from the maximum number down to a single plug may be selected.

More specifically, the key 52 is a component of the tool 10 that is removable and replaceable at any point along the keyway 56 where the helical track 42 crosses the keyway 56. The helix sleeve 40 itself may be marked to show how many plugs will pass before denying passage to make it a simple operation in the field for a rig worker to place the key in the keyway 56 to select a number of plug passages to facilitate a particular operation. It should be noted that because of the high pressures generally encountered in the wellbore for operations related to seating plugs and the potential operations that might be effected by pressuring up on such a plug, for example fracturing at about 10,000 psi, the key 52 should be robust in size and construction as it is, in the end, the key that stops movement of the balance of the components.

Another feature of the tool 10 is that if for any reason, after plug passage has been denied, it is necessary to pass the denied plug, the follower(s) 44 may be released by, for example, shearing and the collet will be able to move to the recess 28 allowing the plug to pass. This is accomplished by pressuring up higher on the tubing to greater than a threshold pressure that is set prior to running the tool 10 in the hole by the number and strength of the followers 44 employed in the tool 10. Thereafter all plugs will pass and no further counting will be possible with the tool 10 without removal thereof from the hole and replacement of one or more followers 44.

Figure 9:
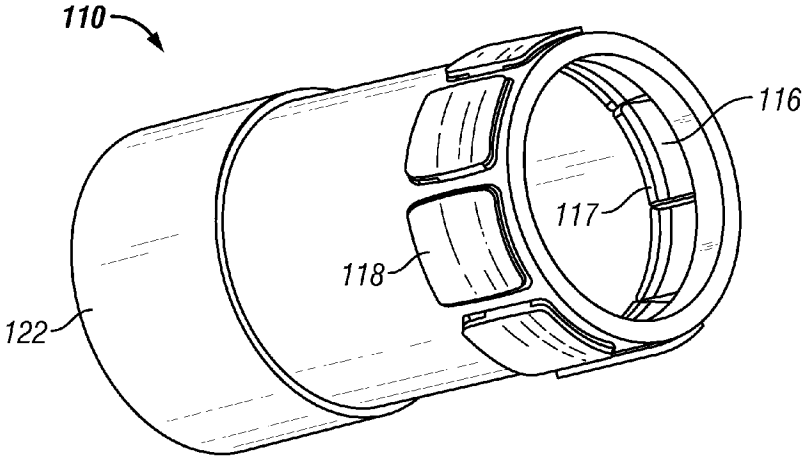
FIG. 9 is a perspective view of an alternate moveable seat substitutable in the tool.
Figure 10:
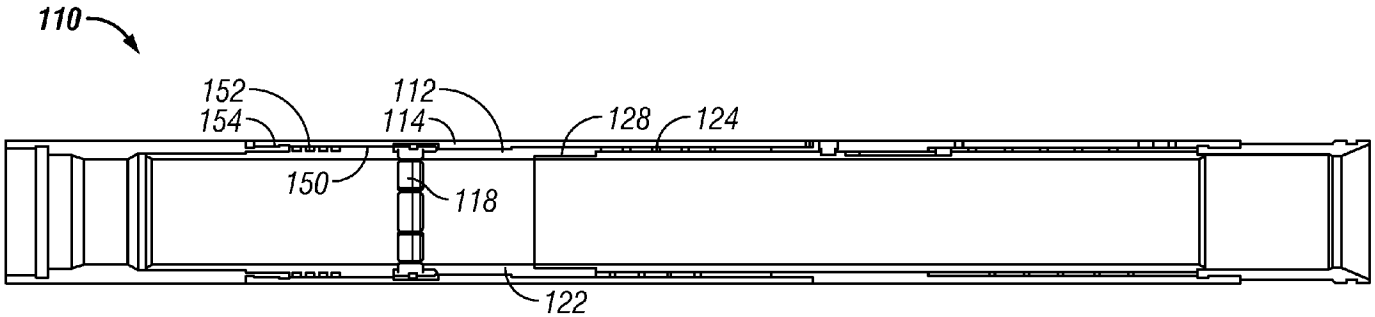
FIG. 10 is a schematic view of a portion of an alternate housing of the tool 10 shown in FIG. 1.

Referring to FIGS. 9 and 10, an alternate embodiment of the tool disclosed above is illustrated. The embodiment operates similarly to the tool 10 and identically operating components are not discussed again. The tool is distinct in that a dog-based seat structure 122, having a plug seat 116, is substituted for the collet 22 in the FIG. 1 embodiment. For clarity, numerals are mimicked in the 100 series. In normal operation the dogs function, as do the fingers 18 from the previous embodiment. The housing 112 is also distinct in that an additional plug passage recess 150 is provided uphole of the support 114 so that in reverse flow, the one or more dogs 118 can be moved into alignment with the recess 150 to allow passage of one or more plugs in the uphole direction as part of a reverse circulation operation to remove the plugs from the borehole. In order for the structure 122 to move uphole, a plug that had been passed in normal operation of the tool 110 is moved in reverse circulation into a seat 117 on the backside of seat 116. The pressure of reverse circulation acts on the plug in the same manner as in the original operation but in the opposite direction. A spring 152 is disposed uphole of the structure 122 and will be compressed against a top sub 154 at a selected force from fluid pressure on the plug. Movement of the structure 122 in the uphole direction mirrors that of movement in the downhole direction and aligns the dogs 118 with the recess 128, which allows the plug to pass. While an embodiment could eliminate spring 152 and simply allow the structure 122 to stay in the uphole position, including the spring 152 provides the added benefit that the device will automatically revert to a functional state after passage of the plug in the uphole direction so that normal operation of the tool 110 could be resumed if desired.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A plug counter comprising:

a housing sized to receive and pass plugs;

a helix sleeve rotatably positioned relative to the housing, the helix sleeve including a helical track having a plurality of consecutive complete turns;

a key positionable relative to the helical track and responsive to movement of the helix sleeve in a first rotational direction, wherein the key prevents further movement of the helix sleeve in the first rotational direction after a selected number of plugs pass through the plug counter; and, a keyway, wherein the key is engageable with the helical track at any position thereon that intersects the keyway.

2. The plug counter of claim 1 further comprising an anti-rotation sleeve disposed about the helix sleeve, the anti-rotation sleeve having the keyway.

3. The plug counter of claim 1 wherein the keyway is arranged in a direction that intersects at least two of the plurality of consecutive turns of the helical track.

4. The plug counter of claim 1, wherein the key is removable and replaceable at any point along the keyway where the helical track crosses the keyway to alter a number of plug passages through the downhole tool.

5. The plug counter of claim 4, wherein a position of engagement of the key with the helical track dictates a number of counts before the key prevents further movement of the helix sleeve.

6. The plug counter of claim 5, wherein the number of counts ranges between 1 and a maximum number selected during manufacture of the counter.

7. The plug counter of claim 5, wherein the number of counts is dictated by a length of the helical track and a length of the keyway.

8. The plug counter of claim 1, wherein the helical track is at an outer surface of the helix sleeve.

9. A plug counter comprising:

a housing sized to receive and pass plugs;

a helix sleeve rotatably positioned relative to the housing, the helix sleeve including a helical track having a plurality of consecutive complete turns;

a key positionable relative to the helical track and responsive to movement of the helix sleeve in a first rotational direction, wherein the key prevents further movement of the helix sleeve in the first rotational direction after a selected number of plugs pass through the plug counter; and, an axially movable sleeve axially movable relative to the housing, wherein axial movement of the axially movable sleeve causes rotational movement of the helix sleeve.

10. The plug counter of claim 9, further comprising a movable plug seat connected to the axially movable sleeve, the movable plug seat configured to catch and subsequently pass the selected number of plugs.

11. The plug counter of claim 9, wherein the axially movable sleeve is movable away from the helix sleeve under spring bias and movable toward the helix sleeve upon receipt of a plug within the housing and subsequent pressure build-up.

12. A downhole tool comprising:

a housing having a support and one or more plug passage recesses;

a movable plug seat positionable to be supported by the support or aligned with the one or more plug passage recesses;

a helix sleeve rotatable relative to the movable plug seat and in response to movement of the movable plug seat, the helix sleeve having a helical track including a plurality of consecutive turns; and, a key responsive to movement of the helix sleeve and configured to prevent further movement of the helix sleeve and movable plug seat after a selected number of movable plug seat movements.

13. The downhole tool of claim 12 further comprising a keyway, wherein the key is engageable with the helical track at any position thereon that intersects the keyway.

14. The downhole tool of claim 13 further comprising an anti-rotation sleeve disposed about the helix sleeve, the anti-rotation sleeve having the keyway.

15. The downhole tool of claim 13 wherein the keyway is arranged in a direction that intersects at least two of the plurality of consecutive turns of the helical track.

16. The downhole tool of claim 13, wherein the key is removable and replaceable at any point along the keyway where the helical track crosses the keyway to alter a number of plug passages through the downhole tool.

17. The downhole tool of claim 12 wherein the movable plug seat is movable towards the helix sleeve upon receipt of a plug and subsequent pressure build-up within the housing, and movable away from the helix sleeve under spring bias.

18. The downhole tool of claim 12 further comprising an axially movable sleeve connected to the movable seat, the axially movable sleeve including surfaces configured to cause a measured rotation of the helix sleeve upon movement of the axially movable sleeve.

19. The downhole tool of claim 18 wherein the helix sleeve includes at least one follower configured to follow the surfaces of the axially movable sleeve.

* * * * *